US005108112A

United States Patent [19]

Gould

[11] Patent Number: 5,108,112

[45] Date of Patent: Apr. 28, 1992

[54] MIDDLE EAST CONFLICT BOARD GAME

[76] Inventor: Debra A. Gould, 5 Meadow Lane St., Palmer, Mass. 01069

[21] Appl. No.: 747,975

[22] Filed: Aug. 21, 1991

[51] Int. Cl.[5] ..... A63F 3/00

[52] U.S. Cl. ..... 273/255; 273/243; 273/141 R; 273/282; 273/287

[58] Field of Search ..... 273/141 R, 243, 248–256, 273/284, 282, 287

[56] References Cited

U.S. PATENT DOCUMENTS

| | | | |
|---|---|---|---|
| 1,656,943 | 1/1928 | Firestone | 273/254 |
| 3,756,604 | 9/1973 | Laszlo | 273/255 |
| 3,844,563 | 10/1974 | Isaac | 273/284 |
| 3,861,686 | 1/1975 | Breslow | 273/141 R |
| 4,783,080 | 11/1988 | Rosenwinkel et al. | 273/255 |

FOREIGN PATENT DOCUMENTS

| | | | |
|---|---|---|---|
| 2066087 | 7/1981 | United Kingdom | 273/256 |

*Primary Examiner*—Benjamin Layno
*Attorney, Agent, or Firm*—H. Jay Spiegel

[57] ABSTRACT

Disclosed is a board game which has, as a theme, various aspects of the recent war in the Middle East involving the United States, Saudi Arabia and Iraq. The game board has a path with a plurality of spaces which are traveled by the players responsive to a chance device. Each player receives a number of barrels of oil and missiles to start the game and the object of the game is for a player to accumulate the most barrels of oil before running out of missiles.

11 Claims, 2 Drawing Sheets

MIDDLE EAST CONFLICT BOARD GAME

BACKGROUND OF THE INVENTION

The present invention relates to a board game known as the Middle East Maniac Game. In the prior art, board games are known including the game of Monopoly and board games generally having a theme of war and conquest. U.S. Pat. No. 2,257,636 to Cohen and U.S. Pat. No. 4,125,262 to Erickson are known. However, the present invention differs from the teachings of these patents as including a theme specifically based upon the recent Middle East War.

SUMMARY OF THE INVENTION

The present invention relates to a board game known as the Middle East Maniac Game. The present invention includes the following interrelated objects, aspects and features:

(A) In a first aspect, the inventive game is played on a generally rectangular board having a closed path around the periphery thereof having a plurality of spaces related to the recent Middle East War. Players take turns throwing dice and going around the board, following instructions on the spaces on which they land.

(B) Centrally located on the board is a spinner having a plurality of different regions thereon which describe different hiding places for a character described as "Saddam". Each location has a slot into which a card may be inserted. A card is inserted in each slot, however, one such card has a likeness of "Saddam" printed thereon. Thus, "Saddam" is "hidden" in one of the locations described on the spinner such as, hotel, tunnel, bunker, missile site, etc. In one aspect of the game, "Saddam" is hidden and players may find him by landing on a space and guessing his location as will be described in greater detail hereinafter (C) A plurality of cards are provided with the game which are chosen when landing on an appropriate space. These cards include cards which give instructions concerning the playing of the game as well as cards which help or hinder a player.

(D) At the beginning of the game, each player is given a plurality of simulated oil barrels and simulated missiles. The object of the game is to accumulate the most barrels of oil before losing all of one's missiles.

As such, it is a first object of the present invention to provide a game known as the Middle East Maniac Game.

It is a further object of the present invention to provide such a game wherein players collect barrels of oil while holding onto protective missiles.

It is a still further object of the present invention to provide such a game wherein a side theme involves the hiding of a character known as "Saddam" and the finding of this character.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 1:
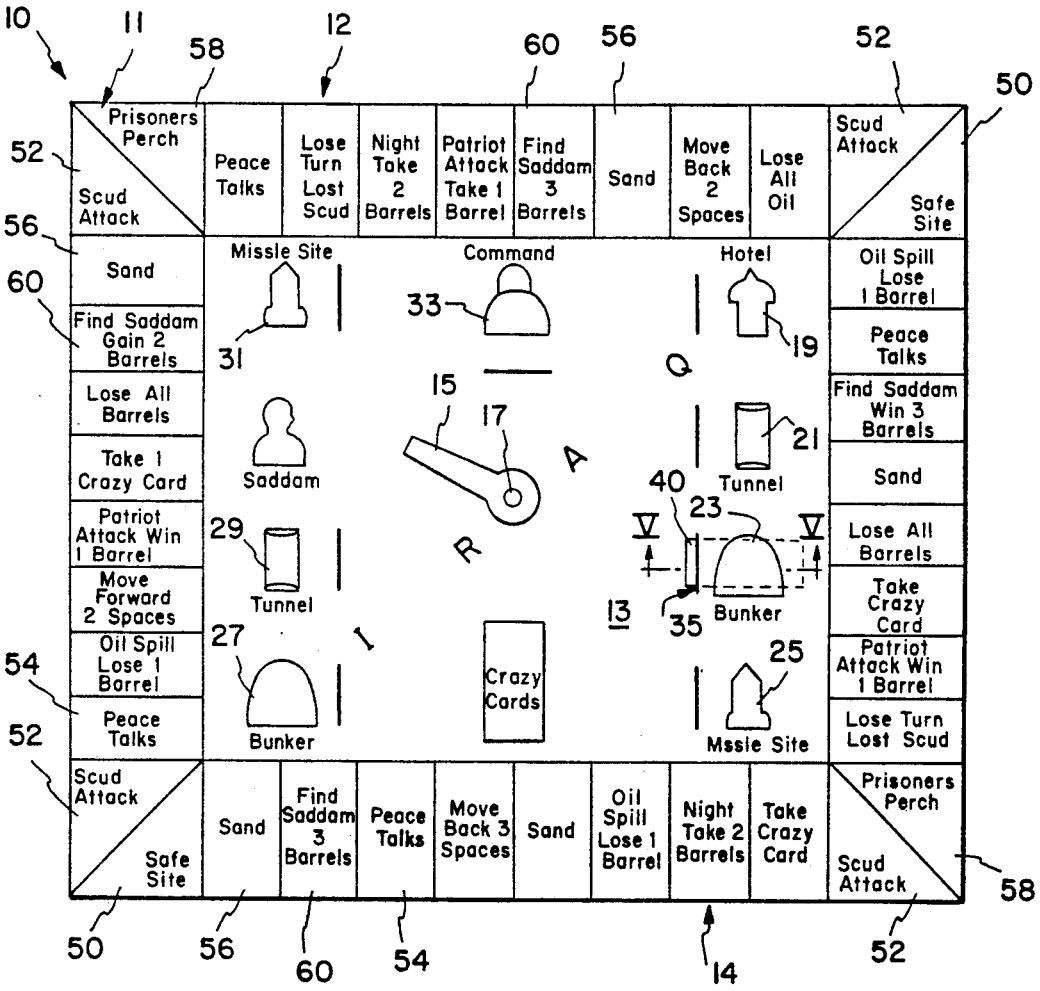
FIG. 1 shows a top view of the game board of the present invention.

With reference to FIG. 1, the inventive game includes, as an essential part thereof, the game board generally designated, in FIG. 1, by the reference numeral 10. The board 10 is seen to include a closed path 11 about the periphery thereof having a multiplicity of spaces as will be described in greater detail hereinafter. Centrally located on the board 10 is a spinner region 13 having a spinner 15 rotatably mounted about a fitting 17 and having a plurality of locations therearound having different hiding places for "Saddam".

Thus, the spinner region 13 has the hiding places hotel 19, tunnel 21, bunker 23, missile site 25, bunker 27, tunnel 29, missile site 31 and command 33. As shown in FIG. 1, each hiding place on the spinner region 13 has an entrance slot of which the slot 35 adjacent the bunker 23 is particularly shown in FIGS. 1 and 5. The structure shown in FIG. 5 is representative of all of the hiding places on the spinner region 13.

Figure 5:
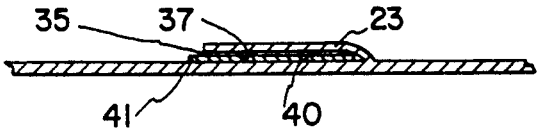
FIG. 5 shows a cross-sectional view along the line V-V of FIG. 1.

As seen in FIG. 5, the slot 35 allows access to an internal chamber 37 in which a card 40 may be hidden with a end 41 thereof protruding outwardly from the slot 35.

Figure 4:
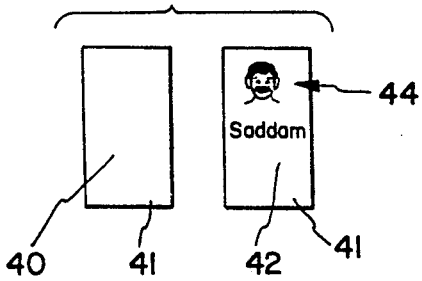
FIG. 4 shows cards which are used in connection with the spinner portion of the inventive game board.

With reference to FIG. 4, the card 40 is shown as is a card 42. In the preferred embodiment of the present invention, there is a single card 42 and a multiplicity of cards 40 with a total number of cards including the card 42 and the cards 40 totalling the number of hiding places on the spinner region 13 of the board 10. Thus, in the playing of the game, as will be described in greater detail hereinafter, a player may hide the "Saddam" card 42 in one of the slots 35 adjacent one of the hiding places on the spinner region 13 of the board 10, with the end 41 of each card protruding outwardly from the respective slots. Thus, when viewing the spinner region 13 from above, each hiding place has a card 40 or 42 protruding therefrom. However, since the printing 44 on the card 42 is not visible in this orientation of the card 42 as hidden within one of the hiding places on the spinner region 13, the other players will not know which card is, in fact, the "Saddam" card.

With further reference to FIG. 1, it is seen that the path 11 includes regions 12 and 14 wherein two parallel paths are provided with the players being able to choose which path to take as they wish.

With further reference to the path 11, certain ones of the spaces will be described in greater detail. Thus, two spaces designated by the reference numeral 50 are printed as "safe site". In commencing the game, players place their game pieces on a "safe site" and begin the game from that location. If, during the playing of the game, a player lands on one of the "safe site" spaces, that player may take another turn. The path 11 also has four spaces designated by the reference numeral 52 and having printed thereon "scud attack". When a player lands on one of these spaces, that player loses one missile as will be described in greater detail hereinafter. However, if that player has in their possession a "crazy card" with the words "scud defense" printed thereon, that player may, at their option, turn in the card rather than losing a missile.

The path 11 has two spaces with the words "peace talks" printed thereon, these spaces being generally designated by the reference numeral 54. When a player lands on one of these spaces, that player must give up all "crazy cards", as will be described in greater detail hereinbelow, which would be considered to be passes, such as, for example, "scud defense", "freedom pass".

The board includes five spaces with the word "sand" thereon, which spaces are generally designated by the reference numeral 56. These spaces are considered to be blank spaces with no value, benefit or detriment.

Two spaces on the board have the words "prisoners' perch" thereon, which spaces are generally designated by the reference numeral 58. When a player lands on one of these spaces, that player must remain there until, through use of the dice, for example, two or five is rolled. However, if a player has in their possession a "crazy card" with the words "freedom pass" printed thereon, that player may, at their option, turn in this card to immediately be released from the "prisoners' perch" 58, or, alternatively, may retain the "freedom pass" card for the future, choosing, instead, to attempt to roll two or five to be released.

There are four spaces on the board designated by the reference numeral 60 and having the words "find Saddam" thereon along with a gain of a certain number of barrels of oil as printed thereon. When a player lands on one of these spaces, that player may attempt to guess where "Saddam" is hidden on the spinner region 13 by pulling one of the cards 40 or 42 out of its hiding place as shown with reference, for example, to FIG. 5. If the player successfully uncovers "Saddam", that player wins the number of oil barrels which are printed on the space 60. If the player fails to uncover "Saddam", that player does not win the number of barrels printed. If a player successfully uncovers "Saddam", winning the number of barrels shown, that player then hides "Saddam" somewhere in one of the hiding places on the spinner region 13 while the other players avert their glances. This procedure gives the player who has successfully found "Saddam" and then subsequently hidden him an advantage since that player may easily find "Saddam" again should that player land on another one of the spaces 60.

The other spaces on the game board 10 are self-explanatory.

Figure 2:
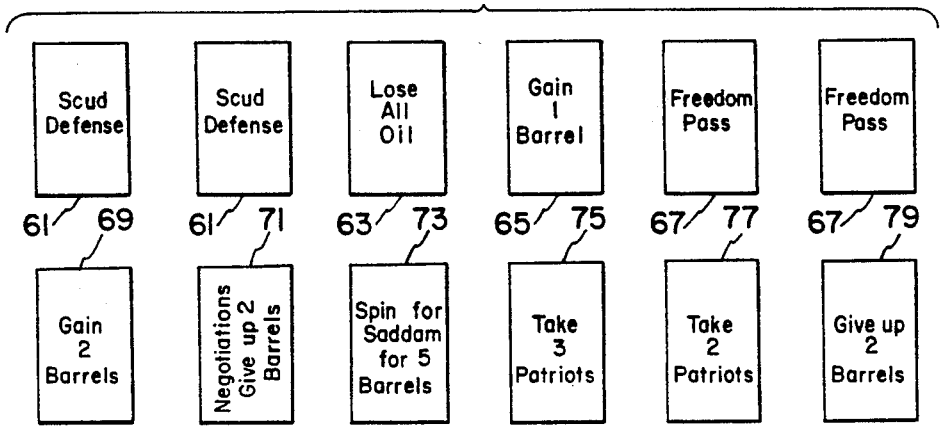
FIG. 2 shows the "crazy cards" which are used in playing the inventive game.

Now, reference is made, to FIG. 2 wherein various "crazy cards" are illustrated. These cards are chosen when landing on a space on the board 10 labelled "take crazy card". These cards include the cards 61 with the words "scud defense" thereon, the card 63 with the words "lose all oil" thereon, the card 65 with the words "gain one barrel" thereon, the card 67 with the words "freedom pass" thereon, the card 69 with the words "gain two barrels" thereon, the card 71 with the words "negotiations give up two barrels" printed thereon, the card 73 with the words "spin for Saddam for five barrels" printed thereon, the card 75 with the words "take three patriots" printed thereon, the card 77 with the words "take two patriots" printed thereon, and the card 79 with the words "give up two barrels" printed thereon.

Now these cards as depicted in FIG. 2 will be explained. When a player picks one of the "scud defense" cards 61, that player may keep that card until it is needed. As explained above, when a player lands on a space having the words "scud attack" printed thereon, that player may use a "scud defense" card 61 to avoid any negative result. If that player does not have, in their possession, a "scud defense" card 61, that player loses one missile. If a player picks a "feedom pass" card 67, that player may hold that card until it is needed to escape from the "prisoners' perch" 58 as described above. Concerning all of the other "crazy cards" depicted in FIG. 2, a player must follow the instructions on the card and then return the card to the pile of cards which is continuously reshuffled. When a player chooses the card 73 which has the words "spin for Saddam for five barrels" printed thereon, that player may spin the spinner 15 and may reveal the card 40 or 42 located where the spinner pointer has stopped. If that player is lucky enough to have spun to the location where the "Saddam" card 42 is located, that player wins five barrels of oil.

Figure 3:
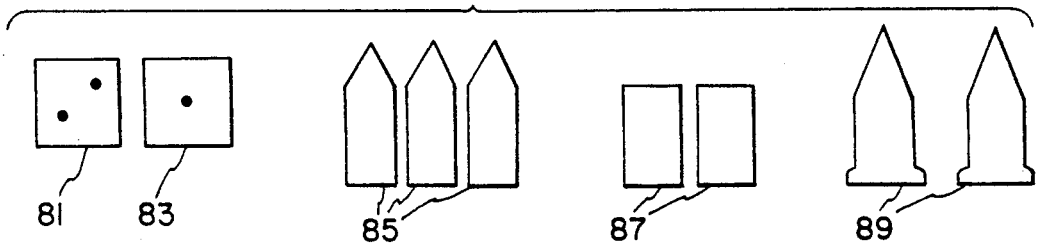
FIG. 3 shows the dice, playing pieces, barrels and missiles which are used in playing the inventive game.

Now, with reference to FIG. 3, it is seen that the inventive game includes several game components including dice 81, 83, playing pieces 85 which are made in different colors and are used as the game pieces moved by the players about the board. Each of the playing pieces 85, in a unique color, is made to resemble an oil tower.

Also shown in FIG. 3 are oil barrel pieces 87 and missile pieces 89.

When the game commences, each player is given four barrels 87 and ten missiles 89. In the playing of the game as should be understood, when a player loses all of their missiles 89, that player is eliminated from the game. When the last person loses all of their missiles, the winner is that player who has the most barrels 87.

Now, a number of miscellaneous rules of the game will be described. As stated above, each person starts the game with four barrels 87 and ten missiles 89 as well as with a game playing piece 85 of a unique color. To establish the order of the players, one die 81 or 83 is thrown by each player and the players play in descending order from the highest number thrown to the lowest. Of course, ties may be broken by subsequent rolls of the single die If, during the playing of the game, a player rolls the dice 81, 83 and rolls "doubles", that player moves the number of spaces corresponding to the number thrown and may roll the dice again.

Each time a player passes one of the "safe site" spaces 50, that player automatically collects another missile 89.

The player who rolled the lowest score when the single die 81 or 83 was thrown to determine the order of play is the person who initially hides the "Saddam" card 42 on the spinner region 13 as explained above. In playing the game, the spinner 15 is used in an attempt to uncover "Saddam" only when the card 73 has been drawn. Otherwise, when a player lands on one of the spaces 60, the spinner is not used but, rather, that player may guess where "Saddam" is hidden in the spinner region 13. Thus, if the player who has hidden "Saddam" picks the card 73, even though that player knows "Saddam's" location, that player must rely upon the spinner to locate the "Saddam" card 42.

As described above, there are several spaces on the board wherein a player may lose one or more barrels of oil. If a player so chooses, that player may alternatively give up a like number of missiles, however running the risk that all missiles may eventually be lost thereby causing elimination from the game.

When a player arrives at one of the regions 12 or 14, that player may choose which one of the parallel paths to take. Such choice may depend upon the roll of the dice or merely an educated guess as to the likely results.

As such, a game has been disclosed in terms of a preferred embodiment thereof which fulfills each and every one of the objects as set forth above and provides an interesting, new and useful game of great novelty and utility.

Of course, various changes, modifications and alterations in the teachings of the present invention may be contemplated by those skilled in the art without departing from the intended spirit and scope thereof. As such, it is intended that the present invention only be limited by the terms of the appended claims.

Claims:

1. A board game, comprising:

a) a board having a plurality of spaces arranged in a closed path about a periphery of said board;

b) a first chance device centrally mounted on said board, said chance device having a plurality of regions which may be randomly chosen by said chance device, each region including a chamber in said board and an access slot;

c) a plurality of first cards, with one first card being inserted into each chamber through a respective said slot, one of said first cards having distinctive printing thereon and all other first cards being blank;

d) a second chance device which is used to control play of said game, said first chance device being used solely, during play of said game under control of said second chance device, to give a player a chance to locate said one of said first cards and thereby win an award;

e) second cards maintained in a stack and chosen sequentially when players land on a particular space during play of said game, one of said second cards when chosen instructing a player to operate said first chance device and thereby attempt to find said one of said first cards.

2. The invention of claim 1, wherein said first chance device comprises a spinner.

3. The invention of claim 1, wherein said second chance device comprises a pair of dice.

4. The invention of claim 1, wherein each player is given, at the beginning of play, a plurality of first objects and a plurality of second objects, and the object of the game is to accumulate the most first objects before losing all of the second objects.

5. The invention of claim 4, wherein said first objects comprise toy oil barrels and said second objects comprise toy missiles.

6. The invention of claim 5, wherein said path includes a "safe site" space with players passing said space winning a toy missile.

7. The invention of claim 6, wherein said path includes a "win barrel" space which when landed upon causes a player to win a toy barrel.

8. The invention of claim 6, wherein said path includes a "lose barrel" space which when landed upon causes a player to lose a toy barrel.

9. The invention of claim 1, wherein one of said spaces when landed upon by a player instructs said player to guess which first card is said one of said first cards without operating said first chance device, said player, if successful in guessing the location of said one of said first cards, winning an award.

10. The invention of claim 1, wherein one of said spaces when landed upon causes a player to lose possessions.

11. The invention of claim 1, wherein said closed path has a region where said path includes two sub-paths which may be selectively chosen by players.

* * * * *